US008842051B1

(12) United States Patent
Mileski

(10) Patent No.: US 8,842,051 B1
(45) Date of Patent: Sep. 23, 2014

(54) OMNIDIRECTIONAL BUOYANT CABLE ANTENNA FOR HIGH FREQUENCY COMMUNICATIONS

(71) Applicant: Paul M. Mileski, Mystic, CT (US)

(72) Inventor: Paul M. Mileski, Mystic, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 221 days.

(21) Appl. No.: 13/630,770

(22) Filed: Sep. 28, 2012

(51) Int. Cl.
*H01Q 1/34* (2006.01)

(52) U.S. Cl.
USPC ..... 343/709; 343/719

(58) Field of Classification Search
USPC ..... 343/709, 719
See application file for complete search history.

(56) References Cited

U.S. PATENT DOCUMENTS

| | | | | |
|---|---|---|---|---|
| 4,766,441 | A * | 8/1988 | Phillips et al. | 343/709 |
| 5,272,486 | A * | 12/1993 | Dickinson | 343/719 |
| 7,411,558 | B1 * | 8/2008 | Pickreign et al. | 343/709 |
| 7,868,833 | B2 * | 1/2011 | Tonn | 343/709 |
| 8,760,355 | B1 * | 6/2014 | Tonn | 343/709 |

* cited by examiner

*Primary Examiner* — Tho G Phan
(74) *Attorney, Agent, or Firm* — James M. Kasischke; Jean-Paul A. Nasser; Michael P. Stanley

(57) ABSTRACT

The invention is a buoyant cable antenna that is towed on the surface of a body of water by a submerged underwater vehicle to allow communication coverage in an omnidirectional pattern in the VHF frequency range and that is also compatible with existing buoyant cable antenna deployment and retrieval systems. The antenna of the present invention comprises a floating cable having four identical antenna elements that are arranged in a cross configuration. The antenna is designed with a system of four shielded inductor units connected in series with the antenna elements to reduce the losses to seawater by the submerged elements and to tune the exposed vertical element and its feed-cable capacitance to resonance which results in greatly increased radiated power at the design frequency of approximately 10-30 MHz.

8 Claims, 1 Drawing Sheet

OMNIDIRECTIONAL BUOYANT CABLE ANTENNA FOR HIGH FREQUENCY COMMUNICATIONS

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER RELATED APPLICATIONS

Not applicable.

BACKGROUND OF THE INVENTION (1) Field of the Invention

The present invention relates to antennas for use with an underwater vehicle, and more specifically to a buoyant cable antenna that is towed by a submerged underwater vehicle to allow communication coverage in an omnidirectional pattern in the frequency range of 10 MHz to 30 MHz that is preferably compatible with existing buoyant cable antenna deployment and retrieval systems.

(2) Description of the Prior Art

Radio frequency communication for submerged underwater vehicles is currently limited to unidirectional signal coverage. Buoyant cable antenna systems consisting of a single floating horizontal antenna element together with a floating transmission line have been and are currently in use that provide for the type of radio frequency communication described above. Unfortunately, unidirectional signal coverage provides limited utility. The radiation efficiency of the current buoyant cable antennas is very low since the horizontal antenna element, which is partially immersed in seawater, encounters wave tilt in order to radiate the vertically polarized signal necessary for surface wave propagation of the signal. What is needed is a buoyant cable antenna that provides a radiation pattern that is omnidirectional in azimuth.

SUMMARY OF THE INVENTION

It is a general purpose and object of the present invention to provide omnidirectional signal coverage; both transmit and receive capability, for submerged underwater vehicles through the use of a buoyant cable antenna that is towed on the surface of the water using antenna elements that are electrically much smaller than the optimum one-half wavelength size.

It is a further object to provide an antenna that greatly reduces the amount of wasted radio signal power that would normally be lost to seawater.

It is another object of the invention to provide an electrical apparatus that maximizes the radiated power of one or more electrically short antenna elements.

It is another object of the invention to have one vertical component of the antenna perpendicular to the ocean surface at all times.

These objects are accomplished through the use of a buoyant cable antenna with a vertical antenna component that eliminates signal null areas. The antenna of the present invention comprises a floating cable having four identical antenna elements that are arranged in a cross configuration. The antenna elements are attached to and protrude from the floating cable. While floating on the water surface, the antenna may rotate freely with minimal signal loss with one antenna element always extended above and perpendicular to the water's surface. Omni-directional coverage is achieved by the vertical posture of one of the antenna elements. The antenna employs a series of shielded inductor units such that each inductor unit is placed in series with each antenna element to reduce the losses to seawater by the submerged elements and to tune the exposed vertical element and its feed-cable capacitance to resonance which results in greatly increased radiated power at the design frequency of approximately 10-30 MHz.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
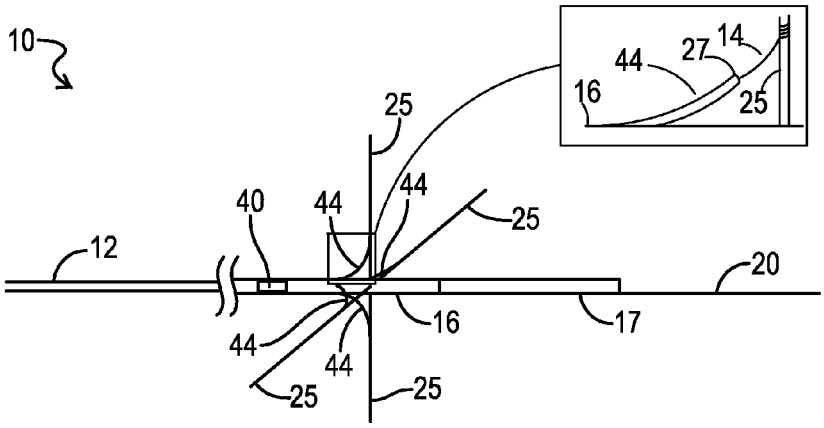
FIG. 1, illustrates the exterior structure of the buoyant cable antenna of the present invention with a close-up view of the element assembly.

Referring to FIG. 1, the present invention teaches a buoyant cable antenna 10 that is towed by a submerged underwater vehicle (not shown) as the antenna 10 floats on the surface of the water 20. The antenna 10 is electrically connected to the underwater vehicle via a coaxial cable transmission line 12. The antenna 10 is composed of three sections; 1) an encapsulating cylindrical encasement 16; 2) a buoyant section 17 comprising a cable made of polyethylene foam that provides the buoyancy in seawater; and 3) four identical antenna elements 14 that are attached to and protrude from encasement 16.

In a preferred embodiment, encasement 16 is made from a potting compound such as a thermo-setting plastic or a silicone rubber gel that is water tight, flexible, tear resistant and meets the tensile requirements for towing a buoyant cable antenna at specified speeds as well as deployment and retrieval by the BRA-24 system. In a preferred embodiment encasement 16 encapsulates the electronics 40 of the antenna 10. In a preferred embodiment buoyant section 17 is a cable made of polyethylene foam that provides the buoyancy in seawater. Encasement 16 is joined to buoyant section 17. In a preferred embodiment the diameter of encasement 16 and buoyant section 17 is 0.65 inch allowing them to conform to the required dimensions of the BRA-24 system.

The antenna elements 14 are held in place by the potting compound of encasement 16. The four identical antenna elements 14 are arranged symmetrically around the encasement 16 in a cross configuration. In operation, at least one element 14 is extended vertically above and perpendicular to the water surface 20 when the antenna 10 is deployed regardless of rotations even as the antenna 10 moves along the surface of the water 20.

In a preferred embodiment, each antenna element 14 is essentially a wire extension of the center conductor of one of four insulated coaxial wires 44 with the coaxial shielding terminated. The end of each of the insulated coaxial wires 44 along with the center conductor connection 27 (junction) to the wire extension/antenna element 14 is insulated to prevent water passing into the insulated coaxial wire 44. Each of the four wire extension/antenna elements 14 is secured respectively to one of four three feet long cylindrical dielectric support rods 25. In a preferred embodiment, cylindrical support rods 25 are fabricated of fiber glass having a diameter of one eighth of an inch. However, the invention is not constrained by the choice of fabrication material and diameter, only length. In an alternative embodiment, the rods 25 are fabricated of electrically conducting material that serve as the actual radiators and are electrically connected directly to the insulated coaxial wires 44.

Figure 2:
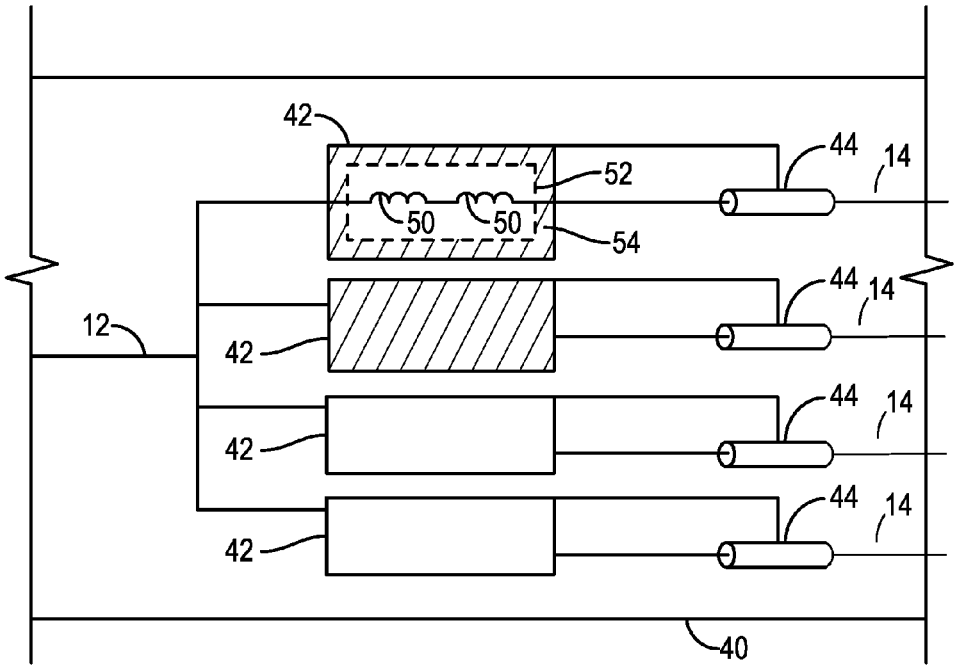
FIG. 2, illustrates a block diagram of the internal shielded inductor series configuration.

Referring to FIG. 2, there is illustrated a preferred embodiment of the electronics 40 consisting of a system of four shielded inductor units 42 electrically connected at one end to transmission line 12 (originating from the towing vessel), and electrically connected at the opposite end to the four insulated coaxial wires 44 such that a single shielded inductor unit 42 is placed in series with a single insulated coaxial wires 44 (that are connected to the four antenna elements 14).

The purpose of the shielded inductor unit system is twofold: 1) each shielded inductor unit 42 generates 1.7 micro-Henrys of inductance and provides a reactance in series with each antenna element 14 that greatly reduces the losses to seawater by the submerged elements; 2) the shielded inductor unit 42 associated with the vertical in-air antenna element 14 serves to tune this exposed antenna element 14 and its feed cable capacitance to resonance, which results in greatly increased radiated power at the design frequency of approximately 16 MHz.

In a preferred embodiment, each shielded inductor unit 42 is fabricated from two inductors 50 preferably with iron powder magnetic cores placed in series, such that the combined inductors 50 generate a preferred inductance in the range of 1-2 micro Henrys. The two joined inductors 50 are encased in an electrically insulating cylindrical housing 52 made of a dielectric material that is in turn enveloped by shielding 54 consisting primarily of a low loss conductor material. The design of the shielded inductor units 42 is essentially a coaxial arrangement that is necessitated in order to prevent electrical losses by the antenna operating environment of seawater.

In one embodiment, the inductors 50 are manufactured by Miller Corporation and consist of two model 5800-3R9-RC, each with all but the first layer of turns removed, placed in series. Each pair of inductors 50 is wrapped in 0.020 inch thick cardboard to physically stabilize the components and provide impact protection. The wrapped pair of inductors is placed inside a 0.020 inch thick polyvinylchloride (PVC) housing 56 of 1.38 inches in length with a 0.335 inch outer diameter, which serves as the electrically insulating housing. The outside of the PVC housing is then encased in a copper shell 58, which serves as the low loss conductor shielding 54.

The shielding 54 of the inductor units 42 is electrically connected to the shields of the insulated coaxial wire 44 while the center conductor of each insulated coaxial wire 44 is connected directly to the inductor pair 50. The inductor units 42 are arranged in tandem inside of encasement 16. The shielding 54 prevents the loss of current due to capacitance between the inductors windings and the RF voltage from the surrounding seawater.

The advantages of the present invention are that the antenna 10 allows communication coverage in an omnidirectional pattern with improved antenna gain at high frequencies. An advantage of the use of inductors 50 is a reduction in loss due to submerged antenna elements 14. The inductors 50 serve as a passive device to reduce current flow to the submerged antenna elements 14. The use of the shielding 54 around each inductor reduces the capacitive coupling of the inductors with the seawater. Finally, the use of inductors 50 to tune the exposed antenna element to resonance greatly increases the antenna gain compared to a non-resonant system.

In light of the above, it is therefore understood that within the scope of the appended claims, the invention may be practiced otherwise than as specifically described.

What is claimed is:

1. A buoyant cable antenna for use with an underwater vehicle comprising:

an encapsulating cylindrical encasement joined to an underwater vehicle via a transmission line, wherein the encasement is made from a potting compound that encapsulates a plurality of electronic components of the antenna that are electrically connected to said transmission line;

a buoyant section joined to said encapsulating cylindrical encasement, wherein said buoyant section is a cable made of polyethylene foam that provides buoyancy in seawater;

four identical antenna elements that are attached to and protrude from said encapsulating cylindrical encasement wherein the four identical antenna elements are arranged symmetrically around the encasement in a cross configuration, wherein in operation at least one element is extended vertically above and perpendicular to the water surface when the antenna is deployed regardless of the encasement rotations as the antenna moves along the surface of the water;

a system of four shielded inductor units, encapsulated by the encapsulating cylindrical encasement electrically, connected at a first end to said transmission line and electrically connected in series at a second end to each of the four identical antenna elements by one of four insulated coaxial wires such that one shielded inductor unit is electrically connected in series to only one antenna element by only one insulated coaxial wire; and wherein the design and dimensions of the buoyant cable antenna allow it to float on the surface of a body of water while being towed by an underwater vehicle to be deployed and retrieved by the U.S. Navy BRA-24 deployment and retrieval system.

2. The antenna of claim 1 wherein each of the four identical antenna elements is a radiating electrically conductive wire that is electrically connected to one of the four insulated coaxial wires and is secured to and supported by a dielectric rod constrained to three feet in length.

3. The antenna of claim 2 wherein each of the four dielectric rods is fabricated from one eighth inch fiberglass cylinders.

4. The antenna of claim 2 wherein the shielded inductor units further comprise:

two inductors with iron powder magnetic cores placed in series comprising an inductor pair, such that the combined inductors generate a preferred inductance in the range of 1-2 micro Henrys;

an insulating cylindrical housing made of a dielectric material that encases the inductor pair;

a shielding consisting primarily of a layer of low loss conductor material disposed over and completely covering the outer surface of the insulating cylindrical housing such that the combination of the two inductors housed in a dielectric material that is enveloped in a layer of low loss conductor material is essentially a coaxial arrangement that is necessitated in order to prevent electrical losses by the antenna operating environment of seawater; and wherein for each of the four shielded inductor unit, the shielding of one of the shielded inductor units is electrically connected to the shield of only one of the insulated coaxial wires, while the center conductor of the insulated coaxial wire is connected directly to the inductor pairs of shielded inductor unit.

5. The antenna of claim 2 wherein the shielded inductor units further comprise:

two model 5800-3R9-RC inductors manufactured by Miller Corporation, each with all but the first layer of turns removed, placed in series and comprising an inductor pair;

cardboard wrapping that wraps the pair of inductors to physically stabilize them and provide impact protection;

a cylindrical polyvinylchloride housing 0.020 inch thick, 1.38 inches in length with a 0.335 inch outer diameter, which serves as an electrically insulating housing; and a copper layer disposed over and completely covering the outer surface of the cylindrical polyvinylchloride housing, wherein said copper layer serves as a low loss conductor shielding;

wherein the copper layer of each of the inductor units is electrically connected to the shield of each of the insulated coaxial wires, while the center conductor of each of the insulated coaxial wires is connected directly to the inductor pair.

6. The antenna of claim 1 wherein each of the four identical antenna elements is constrained to three feet in length and is fabricated from an electrically conductive material.

7. The antenna of claim 1 wherein the potting compound is a thermo-setting plastic that is water tight, flexible, tear resistant and meets the tensile requirements for deployment and retrieval of a buoyant cable antenna in the BRA-24 system.

8. The antenna of claim 1, wherein the diameter of encasement 16 and buoyant section 17 is 0.65 inch allowing them to conform to the required dimensions of the BRA-24 system.

* * * * *